US006422560B1

(12) United States Patent
Harbaugh

(10) Patent No.: US 6,422,560 B1
(45) Date of Patent: Jul. 23, 2002

(54) PICTURE PUZZLE

(76) Inventor: David G. Harbaugh, 26 Sunset Trail, Porter County, IN (US) 46368

( * ) Notice: Subject to any disclaimer, the term of this patent is extended or adjusted under 35 U.S.C. 154(b) by 0 days.

(21) Appl. No.: 09/344,415

(22) Filed: Jun. 26, 1999

Related U.S. Application Data

(60) Provisional application No. 60/090,938, filed on Jun. 27, 1998.

(51) Int. Cl.[7] ..... A63F 9/08

(52) U.S. Cl. ..... 273/157 R; 273/153 S

(58) Field of Search ..... 273/157 R, 153 S, 273/156, 146

(56) References Cited

U.S. PATENT DOCUMENTS

| | | | | | |
|---|---|---|---|---|---|
| 3,845,959 | A | | 11/1974 | Kosareck | 273/153 |
| 3,888,443 | A | | 6/1975 | Flanigen | 248/152 |
| 4,021,939 | A | | 5/1977 | May | 35/69 |
| 4,210,332 | A | | 7/1980 | Shanin | 273/157 |
| 4,210,333 | A | * | 7/1980 | Shanin | |
| 4,407,502 | A | | 10/1983 | Paulos | 273/153 |
| 4,424,971 | A | | 1/1984 | Clark | 273/153 |
| 4,428,581 | A | | 1/1984 | Nagorny | 273/153 |
| 4,437,667 | A | | 3/1984 | Miller | 273/153 |
| 4,494,756 | A | | 1/1985 | Winer | 273/156 |
| 4,508,347 | A | * | 4/1985 | Shettler | |
| 4,715,605 | A | | 12/1987 | Fritzman | 273/156 |
| 4,741,534 | A | | 5/1988 | Rogahn | 273/157 |
| 5,427,375 | A | | 6/1995 | Breckwoldt | 273/153 |
| 5,785,319 | A | * | 7/1998 | Frauhiger | |

* cited by examiner

*Primary Examiner*—William M. Pierce
(74) *Attorney, Agent, or Firm*—Gary M. Hartman; Domenica N. S. Hartman

(57) ABSTRACT

A three-dimensional puzzle cube that offers multiple solutions, each presenting multiple composite images. The composite images are assembled by appropriately arranging individual blocks of the puzzle cube. The blocks are not interconnected, but free to be arranged in a manner required to display the images. The picture puzzle cube generally entails a three-dimensional array of blocks that are arrangeable to form a number of the composite images. The picture puzzle cube has six composite faces defined by the three-dimensional array of blocks, each composite faces being formed by a two-dimensional array of the blocks. Each block has six faces, each face having a fragmentary image of one of the composite images. Six composite images are visible on the six composite faces of the picture puzzle cube at any give time, with the picture puzzle cube having multiple solutions in which a given combination of six composite images are visible.

3 Claims, 5 Drawing Sheets

PICTURE PUZZLE

CROSS REFERENCE TO RELATED APPLICATIONS

This application claims the benefit of U.S. Provisional Application No. 60/090,938, filed Jun. 27, 1998.

BACKGROUND OF THE INVENTION

1. Field of the Invention

The present invention generally relates to picture puzzles. More particularly, this invention relates to a three-dimensional picture puzzle that offers multiple different solutions, each presenting multiple composite images.

2. Description of the Prior Art

Various different forms of three-dimensional puzzles have been proposed, some of which incorporate pictures that one assembles by appropriately arranging the pieces of the puzzle. For example, U.S. Pat. No. 4,407,502 discloses a three-dimensional six-sided picture puzzle cube formed of twenty-six blocks interconnected so that any column or row can be rotated about an axis of the cube. Only those sides of the blocks that are capable of being exposed carry any portion of a puzzle solution. Other three-dimensional puzzles formed of twenty-six interconnected blocks are also known, such as those disclosed in U.S. Pat. Nos. 4,428,581, 4,437,667 and 5,427,375. Three-dimensional puzzles of blocks that are not interconnected are also known, such as U.S. Pat. No. 4,715,605 to Fritzman.

However, Fritzman's puzzle is limited to a two-dimensional array with a single solution being presented at the conclusion of any given game.

SUMMARY OF THE INVENTION

According to the present invention, there is provided a three-dimensional puzzle cube that offers multiple solutions, each presenting multiple composite images. The composite images are assembled by appropriately arranging individual blocks of the puzzle cube. The blocks are not interconnected, but free to be arranged in a manner required to display the images.

The picture puzzle cube of this invention generally entails a three-dimensional array of blocks that are arrangeable to form a number of the composite images. The picture puzzle cube has six composite faces defined by the three-dimensional array of blocks, each composite face being formed by a two-dimensional array of the blocks. Each block has six faces, each face having a fragmentary image of one of the composite images. Six composite images are visible on the six composite faces of the picture puzzle cube at any give time, with the picture puzzle cube having multiple solutions in which a given combination of six composite images are visible. In one embodiment, the puzzle cube is formed by twenty-seven blocks (a 3×3×3 array of blocks), each with portions of eighteen different composite images. When assembled to form the puzzle cube, six different images are simultaneously displayed. The blocks can be rearranged to display two additional solutions, each with six different and complete images. Because the blocks of the puzzle cube can be freely moved about, sets of two or three interrelated images can be provided on certain blocks so that the blocks can be arranged to create panoramic images in a two-dimensional array of 3×6 or 3×9 blocks.

In view of the above, it can be seen that the puzzle cube of this invention provides various different advantages. The puzzle cube incorporates multiple forms of challenging and entertaining picture puzzles, and as such can be used as a competitive game for entertainment purposes by any number of players, as an educational tool with sets of interrelated solutions, or as a souvenir depicting different scenes of a city or attraction.

Other objects and advantages of this invention will be better appreciated from the following detailed description.

BRIEF DESCRIPTION OF THE DRAWINGS

The present invention will be described by way of example, with reference to the accompanying drawings in which.

DETAILED DESCRIPTION OF THE PREFERRED EMBODIMENT

Figure 1:
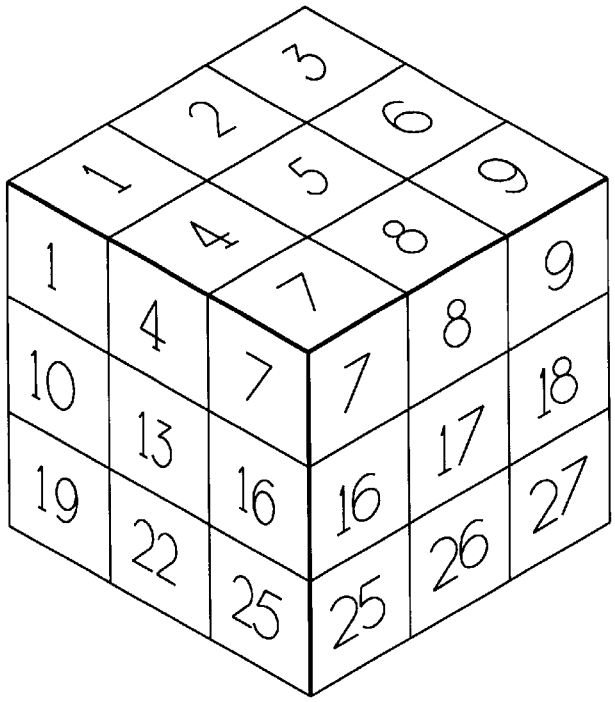
FIG. 1 is a perspective view of a three-dimensional array of blocks assembled to form a puzzle cube in accordance with a preferred embodiment of this invention.
Figure 2:
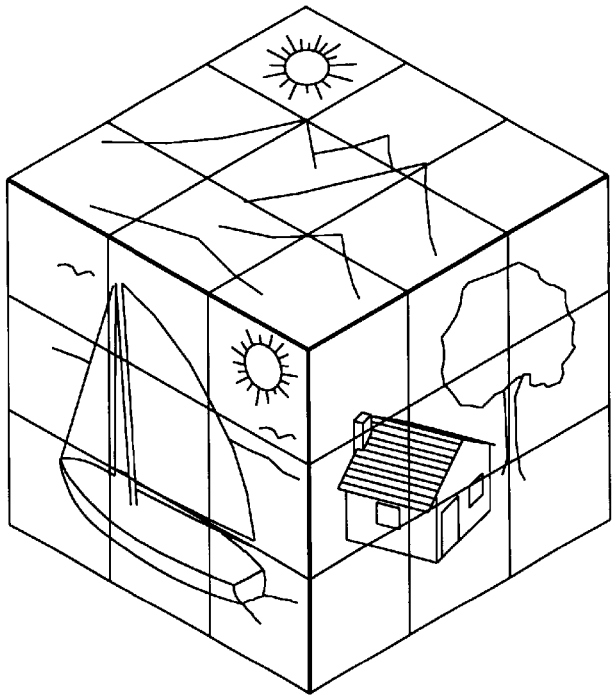
FIG. 2 is a perspective view of the puzzle cube of FIG. 1 with six composite images (three of which are visible in FIG. 2) carried on its six composite faces.

As shown in FIGS. 1 and 2, in a preferred embodiment the invention is a three-dimensional picture puzzle solved by assembling a cube ("puzzle cube") comprised of twenty-seven (3×3×3) identically-sized smaller cubes ("blocks"). As illustrated in FIG. 2, each of the six faces of the puzzle cube contains an individual composite image (e.g., photograph or drawing), each of which is divided into nine (3×3) smaller squares. The nine fragments of each image are attached to the nine faces of the blocks visible on one face of the cube. When assembled correctly, a complete composite image is seen on each face of the puzzle cube. The total number of composite images possible with the picture cube is based on the size of the three-dimensional array of blocks according to the equation $I_c=2(A+B+C)$, where $I_c$ is the number of composite images, and A, B and C are the dimensions of the three-dimensional array in blocks.

Multiple different solutions are possible with the cube, based on the size of the three-dimensional array of blocks and the six composite images visible at any given time, according to the equation $S=I_c/6$, where S is the number of multiple solutions, and $I_c$ is the number of composite images. With the puzzle cube shown in FIGS. 1 and 2, three entirely different solutions of the cube are possible (2(3+3+3)/6), each solution showing a different composite image on each of the six faces of the puzzle cube. Thus, the puzzle cube has eighteen composite images (2(3+3+3)) used in three combinations. Each of the eighteen composite images is divided into nine pieces or fragments; therefore, 162 (18×9) image fragments are used in total, each of which covers one of the 162 faces (27×6) of the twenty-seven blocks. Disassembling and reassembling the puzzle cube using different faces of the individual blocks results in the three solutions to the puzzle cube.

Figure 3:
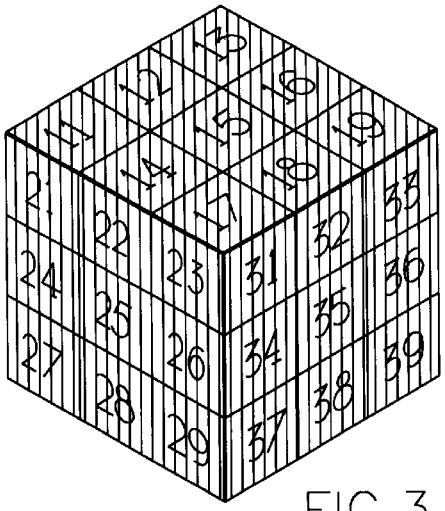
FIGS. 3 through 8 are perspective front and rear views of three different number and color-coded solutions to the puzzle cube of FIGS. 1 and 2.
Figure 4:
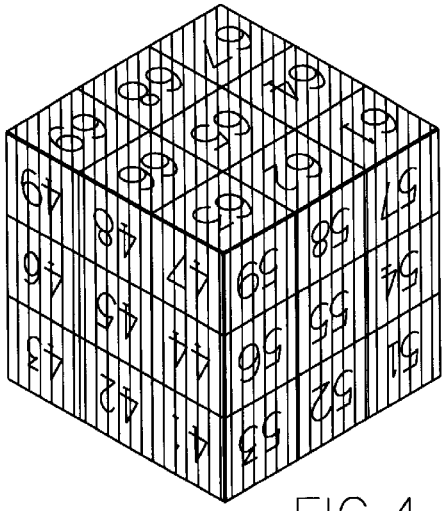
Figure 5:
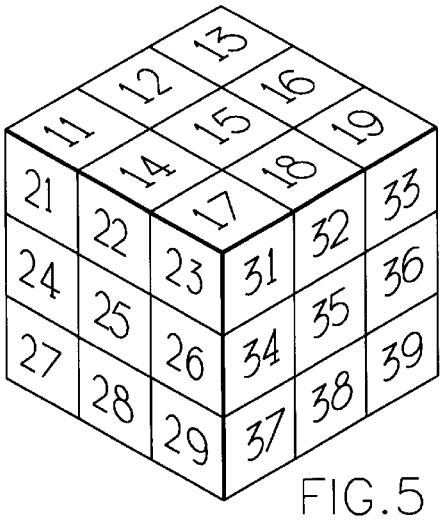
Figure 6:
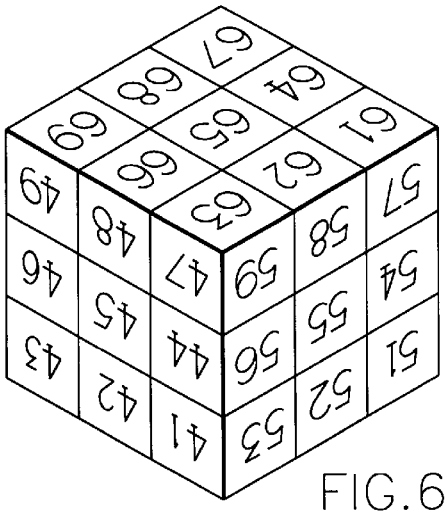
Figure 7:
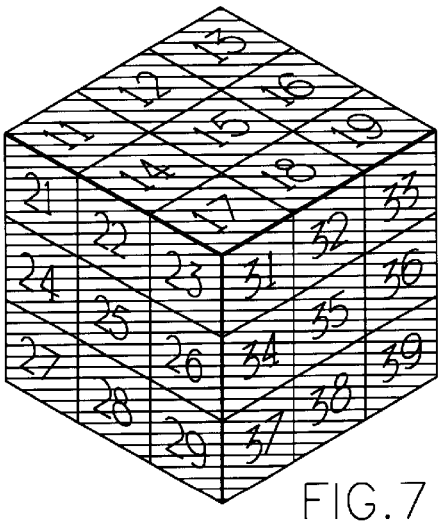
Figure 8:
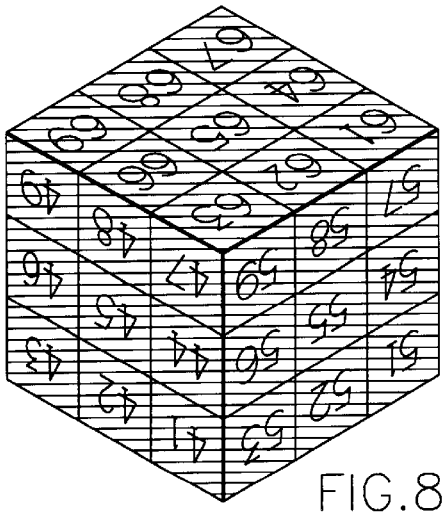
Figure 9:
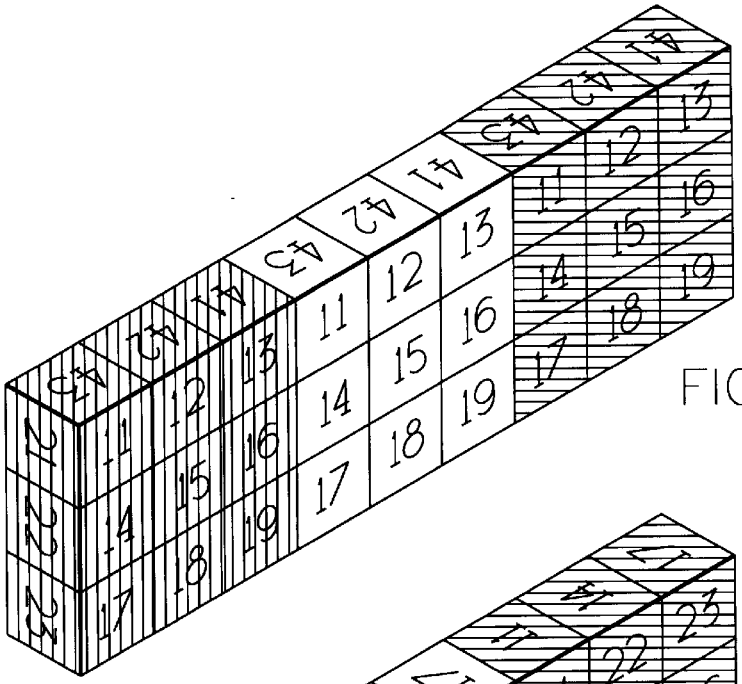
FIGS. 9 through 14 show six different panorama solutions using the puzzle cube of this invention and represented with the number and color-coding scheme from FIGS. 3 through 8.
Figure 10:
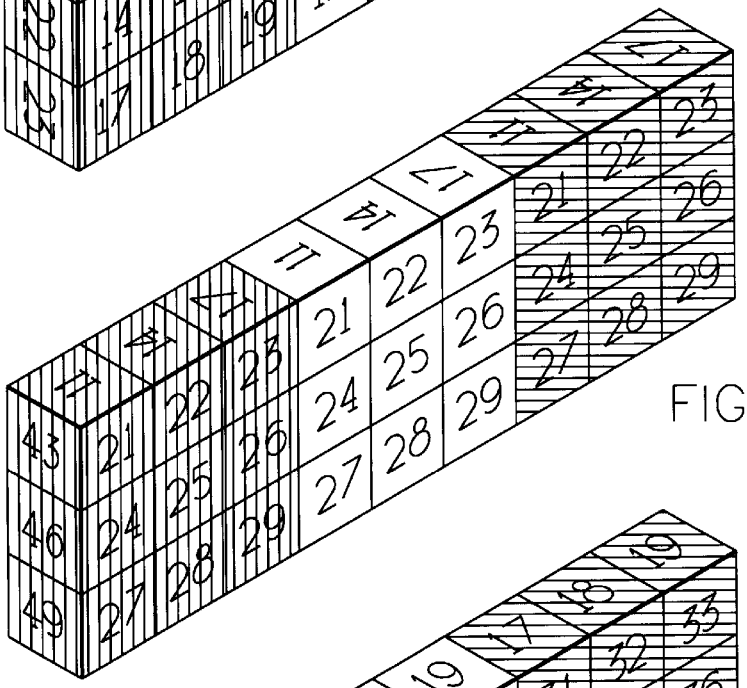
Figure 11:
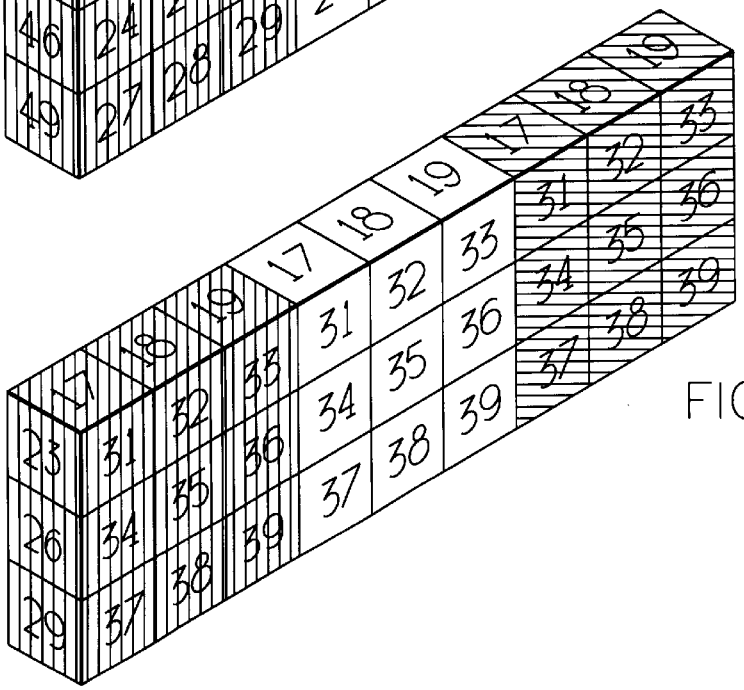
Figure 12:
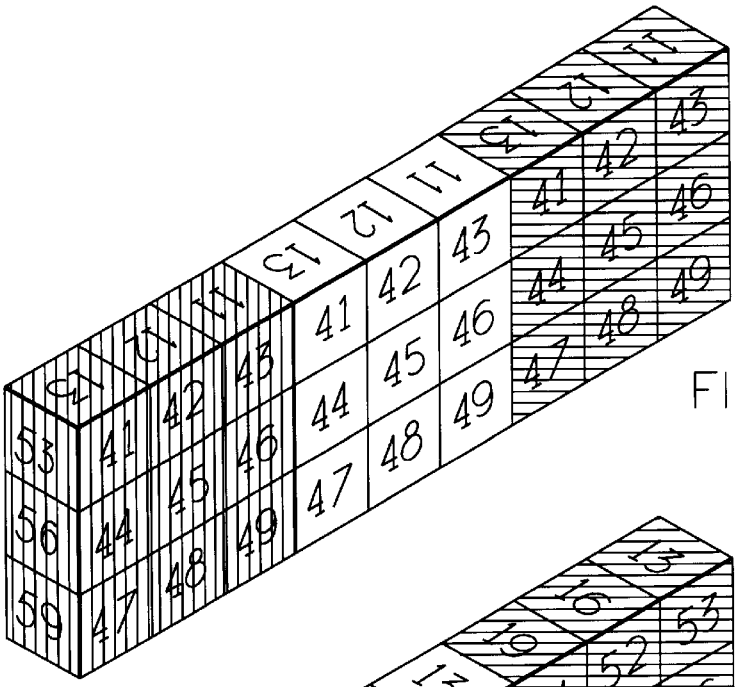
Figure 13:
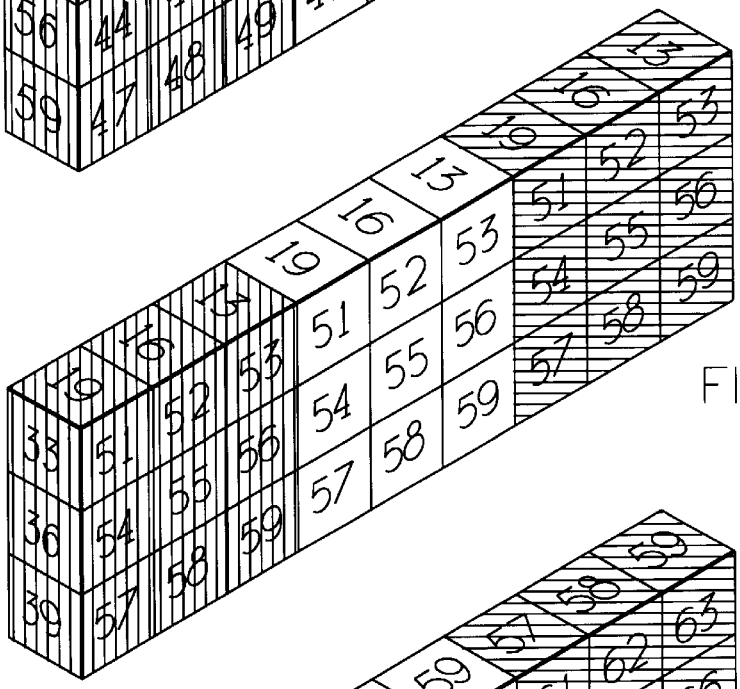
Figure 14:
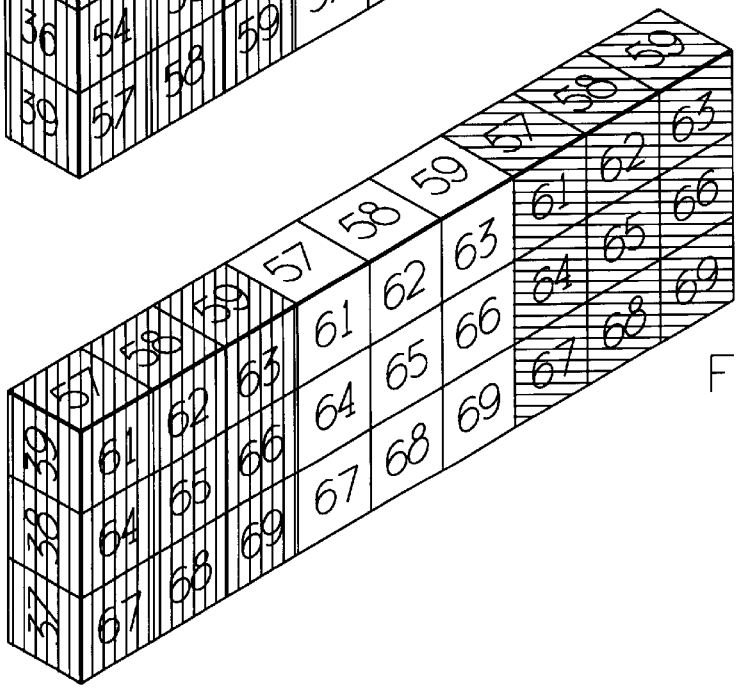

Hereafter, an image fragment will first be referred to by color (red, white or blue) representing which of the three solutions of the puzzle cube it is visible on and a number (e.g., 11–19, 21–29, 31–39, 41–19, 51–59 or 61–69) representing the face of the picture cube it is on and its position on that face. The following Figures show various puzzle cube solutions:

FIG. 3 is an isometric view showing the top, front and left faces of the "red solution," and FIG. 4 is an isometric view showing the bottom, back and right faces of the "red solution" (the red solution being designated by vertical shading in the Figures);

FIG. 5 is an isometric view showing the top, front and left faces of the "white solution," and FIG. 6 is an isometric view showing the bottom, back and right faces of the "white solution"; and FIG. 7 is an isometric view showing the top, front and left faces of the "blue solution," and FIG. 8 is an isometric view showing the bottom, back and right faces of the "blue solution" (the blue solution being designated by horizontal shading in the Figures).

The twenty-seven blocks can be individually categorized by the number of faces visible in each puzzle cube solution on an individual block:

(A) One block will have no faces visible (the block at the center of the cube);

(B) Six blocks will have one face visible (the center block of each cube face);

(C) Eight blocks will have three faces visible (the cube corners); and (D) Twelve blocks will have two faces visible (the blocks between adjacent cube corners).

The following Table I outlines the arrangement of the blocks in the puzzle cube (block numbers do not correspond to those used in FIG. 1). Table I indicates the number of faces of each block visible for each solution (red, white and blue) and the total number of faces utilized in that block. Note that each solution column (i.e., red, white and blue) contains one zero (0), six ones (1), eight threes (3), and twelve twos (2), as required. Also note that the sum of the faces utilized in all solutions (red+white+blue) equals six, the total number of faces on an individual block.

TABLE I

| NUMBER OF BLOCK FACES UTILIZED | | | | |
|---|---|---|---|---|
| BLOCK | SOLUTION RED | SOLUTION WHITE | SOLUTION BLUE | TOTAL FACES IN ALL SOLUTIONS |
| 1 | 3 | 3 | 0 | 6 |
| 2 | 3 | 0 | 3 | 6 |
| 3 | 0 | 3 | 3 | 6 |
| 4 | 3 | 2 | 1 | 6 |
| 5 | 3 | 2 | 1 | 6 |
| 6 | 3 | 2 | 1 | 6 |
| 7 | 3 | 1 | 2 | 6 |
| 8 | 3 | 1 | 2 | 6 |
| 9 | 3 | 1 | 2 | 6 |
| 10 | 1 | 3 | 2 | 6 |
| 11 | 1 | 3 | 2 | 6 |
| 12 | 1 | 3 | 2 | 6 |
| 13 | 2 | 3 | 1 | 6 |
| 14 | 2 | 3 | 1 | 6 |
| 15 | 2 | 3 | 1 | 6 |
| 16 | 1 | 2 | 3 | 6 |
| 17 | 1 | 2 | 3 | 6 |
| 18 | 1 | 2 | 3 | 6 |
| 19 | 2 | 1 | 3 | 6 |
| 20 | 2 | 1 | 3 | 6 |
| 21 | 2 | 1 | 3 | 6 |
| 22 | 2 | 2 | 2 | 6 |
| 23 | 2 | 2 | 2 | 6 |
| 24 | 2 | 2 | 2 | 6 |
| 25 | 2 | 2 | 2 | 6 |
| 26 | 2 | 2 | 2 | 6 |
| 27 | 2 | 2 | 2 | 6 |

Figure 15:
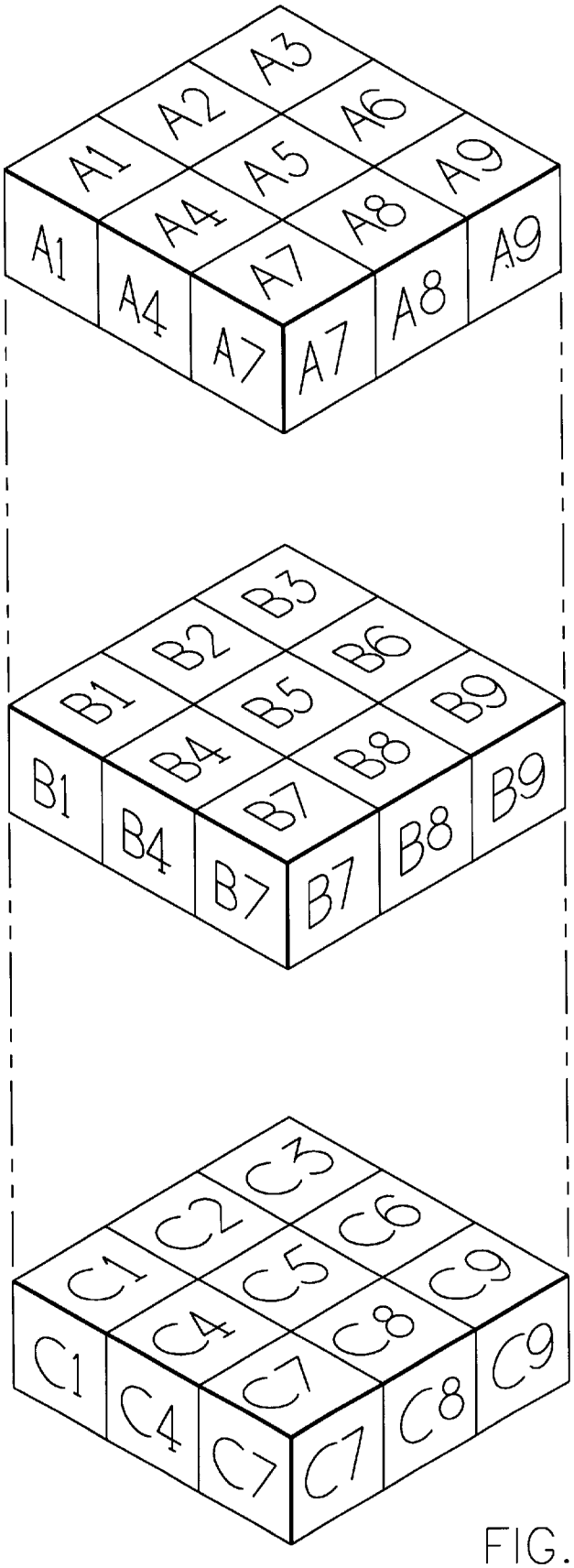
FIG. 15 shows the puzzle cube separated into three separate tiers with a position numbering system to illustrate and explain picture fragment placement.

The placement of image fragments of the block faces is explained in Table II with reference to block numbers as shown in FIG. 1, block positions shown in FIG. 15, and the color coded positions used in FIGS. 3 through 8. Blocks with position numbers A1 through A9 are on the top layer of the cube, blocks with position numbers B1 through B9 are on the middle layer, and blocks with position numbers C1 through C9 are on the bottom layer of the cube. Block layers are stacked above and/or below blocks with the same last position digit. Image fragment orientation is also critical, and is best accomplished an entire puzzle cube face at a time.

TABLE II

| Block # | Position | Top | Left | Front | Back | Right | Bottom |
|---|---|---|---|---|---|---|---|
| 1 | A1 | Red 11 | Red 21 | White 38 | Red 43 | Blue 55 | White 62 |
| 2 | A2 | Red 12 | Blue 25 | White 39 | Red 42 | White 57 | White 63 |
| 3 | A3 | Red 13 | White 29 | White 37 | Red 41 | Red 53 | White 61 |
| 4 | A4 | Red 14 | Red 22 | Blue 36 | White 48 | Blue 54 | White 68 |
| 5 | A5 | Red 15 | Blue 26 | Blue 34 | White 47 | White 59 | White 69 |
| 6 | A6 | Red 16 | White 27 | Blue 35 | White 49 | Red 52 | White 67 |
| 7 | A7 | Red 17 | Red 23 | Red 31 | Blue 44 | Blue 56 | White 65 |
| 8 | A8 | Red 18 | Blue 24 | Red 32 | Blue 46 | White 58 | White 66 |
| 9 | A9 | Red 19 | White 28 | Red 33 | Blue 45 | Red 51 | White 64 |
| 10 | B1 | White 18 | Red 24 | White 32 | Red 46 | Blue 58 | Blue 62 |
| 11 | B2 | White 19 | Blue 28 | White 33 | Red 45 | White 51 | Blue 68 |
| 12 | B3 | White 17 | White 23 | White 31 | Red 44 | Red 56 | Blue 65 |
| 13 | B4 | White 12 | Red 25 | Blue 39 | White 42 | Blue 57 | Blue 61 |
| 14 | B5 | White 13 | Blue 29 | Blue 37 | White 41 | White 53 | Blue 67 |
| 15 | B6 | White 11 | White 21 | Blue 38 | White 43 | Red 55 | Blue 64 |
| 16 | B7 | White 15 | Red 26 | Red 34 | Blue 47 | Blue 59 | Blue 63 |
| 17 | B8 | White 16 | Blue 27 | Red 35 | Blue 49 | White 52 | Blue 69 |
| 18 | B9 | White 14 | White 22 | Red 36 | Blue 48 | Red 54 | Blue 66 |
| 19 | C1 | Blue 16 | Red 27 | White 35 | Red 49 | Blue 52 | Red 69 |

TABLE II-continued

| Block # | Position | Top | Left | Front | Back | Right | Bottom |
|---|---|---|---|---|---|---|---|
| 20 | C2 | Blue 14 | Blue 22 | White 36 | Red 48 | White 54 | Red 66 |
| 21 | C3 | Blue 15 | White 26 | White 34 | Red 47 | Red 59 | Red 63 |
| 22 | C4 | Blue 19 | Red 28 | Blue 33 | White 45 | Blue 51 | Red 68 |
| 23 | C5 | Blue 17 | Blue 23 | Blue 31 | White 44 | White 56 | Red 65 |
| 24 | C6 | Blue 18 | White 24 | Blue 32 | White 46 | Red 58 | Red 62 |
| 25 | C7 | Blue 13 | Red 29 | Red 37 | Blue 41 | Blue 53 | Red 67 |
| 26 | C8 | Blue 11 | Blue 21 | Red 38 | Blue 43 | White 55 | Red 64 |
| 27 | C9 | Blue 12 | White 25 | Red 39 | Blue 42 | Red 57 | Red 61 |

After the puzzle cube is assembled in any one of the three solutions as shown in FIGS. 3 through 8, any visible picture cube face (i.e., top, bottom, left, right,front or back) can be placed face-up on a table, so that the nine blocks that make up the cube face (and the corresponding composite image) rest on the table. If furnished with appropriate images, the remaining eighteen blocks can be rearranged in four different ways to create a panorama image utilizing all twenty-seven blocks. The preferred reorganization is shown in FIGS. 9 through 14.

In view of the above, it can be seen that there are many advantages to the puzzle cube of this invention. The puzzle cube incorporates multiple forms of challenging and entertaining picture puzzles. Although the puzzle cube contains only twenty-seven pieces, the invention can prove more challenging than a 162-piece jigsaw puzzle, depending on the images chosen. Images for the puzzle cube can be supplied by the user, with the faces of each block being equipped with a tacky adhesive or compartments for photographs or the like, which can be replaced when so desired. The puzzle cube would preferably be made available with block faces color-coded and numbered, as discussed above, and with instructions for making a personalized picture puzzle cube. Alternatively, the puzzle cube can be equipped with permanent images, as would be the case if sold as a souvenir depicting different scenes of a city, attraction, etc. For example, the puzzle could depict eighteen different pictures of Washington, D.C. or Chicago, for use as a memento from a vacation. The puzzle cube is preferably provided with a clear cubic storage/display case, which simplifies storage in a partially completed state unlike larger jigsaw puzzles, and allows the completed puzzle cube to be displayed on a bookcase.

The picture puzzle of this invention is intended to be used for entertainment purposes, and can be enjoyed by one or two persons solving it at leisure or by a few players in a competitive game. The cube could also be used as a game for multiple players. For example, in pursuit of either a three-dimensional or panorama puzzle solution, a random face of a random block can be placed face up in the center of a table, with the remaining blocks placed face-up in a common access tray. Play rotates around the table, with the object being to be the player to utilize the most blocks in the picture puzzle solution. Players play only blocks adjacent to the starter block or other previously played blocks. A player is only permitted to touch one block on the access tray on his or her turn. Play becomes more difficult as fewer blocks remain on the access tray with a playable image fragment face up. Players may be awarded a chip for each block correctly placed; the player with the most chips at the completion of the puzzle wins. Six different solutions would be available for each panorama picture puzzle game, and three for a more difficult three-dimensional puzzle cube game.

The picture puzzle may also be used as an educational tool with appropriate images. An example is where each one of the three possible three-dimensional puzzle cube solutions depicts a given year of technology achievement (i.e., 1905, 1945 and 1995), each of the six faces of the puzzle cube could display the current mode of a type of travel available that year (e.g., bicycles, automobiles, trains, ships, airplanes, etc.). When assembled as the puzzle cube, various vehicles would be shown for a give year. When the blocks are reassembled into one of the six panorama images, the evolution of an individual vehicle would be contrasted for the three different years.

While the invention has been described in terms of a preferred embodiment, it is apparent that other forms could be adopted by one skilled in the art. For example, additional combinations for other potential puzzle cubes are available (e.g., a 2×3×3 cube, a 3×3×4 cube, a 4×4×4 cube, etc.). Accordingly, it should be understood that the invention is not limited to the specific embodiment illustrated in the Figures, though all would be based upon the same basic configurations. Instead, the scope of the invention is to be limited only by the following claims.

What is claimed is:

1. A picture puzzle cube comprising a three-dimensional array of blocks, the three-dimensional array having dimensions of 3 by 3 by 3 blocks, the blocks being arrangeable to form eighteen composite pictorial images, the picture puzzle cube having six composite faces defined by the three-dimensional array of blocks, each of the composite faces being formed by a two-dimensional array of the blocks, each block having six faces, each face having a fragmentary image of one of the composite pictorial images, six of the composite pictorial images being visible on the six composite faces of the picture puzzle cube at any give time, the picture puzzle cube having three different solutions;

wherein placement of the fragmentary images on the faces of the blocks is set forth in the following table in which the blocks are identified by block numbers 1 through 27 and placement of each fragmentary image on a block is specified by a code used in FIGS. 3 through 8, in which the code comprises a color identifier and a numeric identifier in reference to which of the three multiple solutions and where on the composite faces, respectively, a fragmentary image is visible in accordance with FIGS. 3 through 8, in which the color identifier is red if the fragmentary image is visible in the solution illustrated in FIGS. 3 and 4, the color identifier is white if the fragmentary image is visible in the solution illustrated in FIGS. 5 and 6, and the color identifier is blue if the fragmentary image is visible in the solution illustrated in FIGS. 7 and 8:

| No. | Top | Left | Front | Back | Right | Bottom |
|---|---|---|---|---|---|---|
| 1 | Red 11 | Red 21 | White 38 | Red 43 | Blue 55 | White 62 |
| 2 | Red 12 | Blue 25 | White 39 | Red 42 | White 57 | White 63 |
| 3 | Red 13 | White 29 | White 37 | Red 41 | Red 53 | White 61 |
| 4 | Red 14 | Red 22 | Blue 36 | White 48 | Blue 54 | White 68 |
| 5 | Red 15 | Blue 26 | Blue 34 | White 47 | White 59 | White 69 |
| 6 | Red 16 | White 27 | Blue 35 | White 49 | Red 52 | White 67 |
| 7 | Red 17 | Red 23 | Red 31 | Blue 44 | Blue 56 | White 65 |
| 8 | Red 18 | Blue 24 | Red 32 | Blue 46 | White 58 | White 66 |
| 9 | Red 19 | White 28 | Red 33 | Blue 45 | Red 51 | White 64 |
| 10 | White 18 | Red 24 | White 32 | Red 46 | Blue 58 | Blue 62 |
| 11 | White 19 | Blue 28 | White 33 | Red 45 | White 51 | Blue 68 |
| 12 | White 17 | White 23 | White 31 | Red 44 | Red 56 | blue 65 |
| 13 | White 12 | Red 25 | Blue 39 | White 42 | Blue 57 | Blue 61 |
| 14 | White 13 | Blue 29 | Blue 37 | White 41 | White 53 | Blue 67 |

-continued

| No. | Top | Left | Front | Back | Right | Bottom |
|---|---|---|---|---|---|---|
| 15 | White 11 | White 21 | Blue 38 | White 43 | Red 55 | Blue 64 |
| 16 | White 15 | Red 26 | Red 34 | Blue 47 | Blue 59 | Blue 63 |
| 17 | White 16 | Blue 27 | Red 35 | Blue 49 | White 52 | Blue 69 |
| 18 | White 14 | White 22 | Red 36 | Blue 48 | Red 54 | Blue 66 |
| 19 | Blue 16 | Red 27 | White 35 | Red 49 | Blue 52 | Red 69 |
| 20 | Blue 14 | Blue 22 | White 36 | Red 48 | White 54 | Red 66 |
| 21 | Blue 15 | White 26 | White 34 | Red 47 | Red 59 | Red 63 |
| 22 | Blue 19 | Red 28 | Blue 33 | White 45 | Blue 51 | Red 68 |
| 23 | Blue 17 | Blue 23 | Blue 31 | White 44 | White 56 | Red 65 |
| 24 | Blue 18 | White 24 | Blue 32 | White 46 | Red 58 | Red 62 |
| 25 | Blue 13 | Red 29 | Red 37 | Blue 41 | Blue 53 | Red 67 |
| 26 | Blue 11 | Blue 21 | Red 38 | Blue 43 | White 55 | Red 64 |
| 27 | Blue 12 | White 25 | Red 39 | Blue 42 | Red 57 | Red 61 |

2. A picture puzzle cube according to claim 1, wherein at least two of the two-dimensional arrays are combinable so that their respective composite pictorial images are combinable to form a single panoramic composite pictorial image.

3. A picture puzzle cube according to claim 1, further comprising a three-dimensional transparent display in which the picture puzzle cube is assembled.

* * * * *